United States Patent [19]

Darr et al.

[11] Patent Number: 4,589,490

[45] Date of Patent: May 20, 1986

[54] WELL BORE RECOMPLETION

[75] Inventors: Carey D. K. Darr; Eric K. Brown, both of Hobbs, N. Mex.

[73] Assignee: Conoco Inc., Ponca City, Okla.

[21] Appl. No.: 669,418

[22] Filed: Nov. 8, 1984

[51] Int. Cl.[4] ..... E21B 43/04

[52] U.S. Cl. ..... 166/276; 166/278; 166/295

[58] Field of Search ..... 166/276, 295, 285, 281, 166/278, 244 R

[56] References Cited

U.S. PATENT DOCUMENTS

| | | | |
|---|---|---|---|
| 2,193,808 | 3/1940 | Dieterich | 166/276 |
| 3,107,727 | 10/1963 | Howard | 166/276 |
| 3,209,823 | 10/1965 | Winkel | 175/44 |
| 3,212,577 | 10/1965 | Holbert et al. | 166/295 |
| 3,336,980 | 8/1967 | Rike | 166/295 |
| 3,379,253 | 4/1968 | Chism | 166/295 |
| 3,542,132 | 11/1970 | Mulrhead | 166/276 |
| 3,559,736 | 2/1971 | Bombardieri | 166/276 |
| 3,708,013 | 1/1973 | Dismukes | 166/276 |
| 3,709,298 | 1/1973 | Pramann | 166/276 |
| 3,918,522 | 11/1975 | Suman | 166/285 |
| 3,929,191 | 12/1975 | Graham et al. | 166/276 |
| 3,999,608 | 12/1976 | Smith | 166/278 |

*Primary Examiner*—Stephen J. Novosad
*Assistant Examiner*—Hoang C. Dang
*Attorney, Agent, or Firm*—A. Joe Reinert

[57] ABSTRACT

Well bores employed for production of hydrocarbons having open hole completion and zonal breakdown in the locus of the well bore are recompleted, advantageously for injection of a fluid such as $CO_2$ in an enhanced oil recovery process. Recompletion is effected by packing off the open hole interval, emplacing a particulate material in the packed off interval and broken down zone, adhering the particulates together with an adhesive to form a permeable synthetic rock-like material, reaming out the open hole interval to a greater diameter than the original completion, setting a casing over the open hole interval, cementing between the casing and the reamed out hole, and perforating at the zones to be isolated and to be communicated with from the well bore, e.g., for $CO_2$ injection.

5 Claims, 8 Drawing Figures

WELL BORE RECOMPLETION

BACKGROUND OF THE INVENTION

1. Field of the Invention

The invention relates to completion of bore holes. In one aspect, the invention relates to recompletion of an open hole bore hole so as to isolate a permeable zone in a subterranean formation from other permeable zones in the subterranean formation. In a more specific aspect, the invention relates to recompletion of an open hole well bore of a production well that had been stimulated by detonation of high explosives so as to make the recompleted well suitable for injection of a fluid in a fluid drive process, for example, in an enhanced oil recovery process involving injection of carbon dioxide ($CO_2$).

2. Brief Description of the Prior Art

The following, among other things, comprises a prior art statement in accordance with the guidance and requirements of 37 CFR 1.5, 1.97, and 1.98.

There are situations when it is advantageous to recomplete an open hole well bore so as to establish fluid communication between the well bore and a permeable zone of a subterranean formation to the exclusion of communication with other permeable zones in the subterranean formation.

An example of a situation in which such recompletion is highly advantageous is in the implementation of an enhanced oil recovery process involving injection of a fluid from an injection well into a permeable subterranean formation containing residual hydrocarbons, so as to cause the hydrocarbons to migrate to a production well, with production of the hydrocarbons or oil to the surface from the production well. More specifically, after depletion by primary production, and even after water flooding, is completed, it is often advantageous to institute an enhanced oil recovery process involving injection of $CO_2$ into injection wells and production of displaced hydrocarbons from production wells.

Primary production is often from open hole completions. That is, a casing is set from the surface to near the production horizon, the casing is cemented into place, and then the well is drilled and completed open hole, without casing, to depth. To stimulate production, it is common practice in many reservoirs to detonate high explosives such as nitroglycerin in the well bore at selected sites near subterranean zones of high permeability that produce hydrocarbons or oil. This is often effected where there are numerous production horizons so as to make sure that all producible zones are opened for production. Thus, high rates of production are obtained, and there is little chance of missing a zone of potential production, which might be true if a cased hole were perforated at intervals indicated to be productive, as by well logs.

The foregoing procedure works fine as long as primary production lasts. However, there comes a time with all reservoirs when primary production becomes uneconomic. When this occurs, very large amounts of unrecovered oil may still be left in the reservoir. At such time, it is often advantageous to institute an enhanced oil recovery process, for example, involving injection of $CO_2$ into production wells and recovery of displaced oil from production wells.

In the development of such an enhanced oil recovery process, considerable savings of time, energy, and funds involved with drilling new wells can be realized if open hole well bores having zonal breakdown in the locus of the well bore can be reconstituted so as to isolate permeable zones of interest from other permeable zones in the subterranean formation. This has heretofore not been feasible, particularly when the open zones were blasted with nitroglycerin or other high explosives. Greatly added expenses of drilling new patterns of new injection wells were required.

The process of the invention is advantageous for effecting considerable savings by recompleting such open hole production wells for conversion to injection wells for use in such fluid drive processes.

It is known in the prior art to form permeable sheaths of "synthetic permeable rock" around well bores so as to mitigate sand production. It is also known to squeeze thermosetting resin and particulate material through perforations into cavities in a formation, and then to drill out the plug in the well, after setup, so as to mitigate sand production problems. Specifically, U.S. Pat. No. 3,929,191 is exemplary of a process wherein epoxy resin or phenolic resin coated sand grains are squeezed through perforations in a casing into cavities in a formation, the mixture is allowed to set up into a consolidated permeable synthetic rock-like mass under influence of heat from the subterranean formation, the plug in the well is drilled out, and the permeable plugs in the cavities are left in place to mitigate sand production.

Relating in another way to the invention, U.S. Pat. No. 3,918,522 is exemplary of prior art disclosing isolating formations by casing, cementing, and then perforating into the zone of interest.

It is apparent, however, that this procedure is not feasible when the zone of interest has been broken down by blasting or sand production, since the cement squeezed into the cavity would be difficult or impossible to perforate.

The inventors are also aware of U.S. Pat. No. 3,542,132; U.S. Pat. No. 3,999,608; U.S. Pat. No. 3,107,727; U.S. Pat. No. 3,209,823; U.S. Pat. No. 3,336,980; U.S. Pat. No. 3,708,013; U.S. Pat. No. 3,709,298; and U.S. Pat. No. 3,929,191, which are cumulative to the references specifically discussed above, or which show the state of the art as applying to one step or another of the inventive sequence of steps comprising the process claimed in this application.

However, none of the references suggest or make obvious the obtaining of the new result obtained by the steps of the process claimed herein.

OBJECTS OF THE INVENTION

An object of the invention is to provide a process for recompleting an open hole well bore having zonal breakdown in the locus of the well bore such as to reconstitute isolation of a permeable zone from other permeable zones in a subterranean formation.

SUMMARY OF THE INVENTION

An open hole well bore having zonal breakdown in the locus of the well bore is recompleted to reconstitute isolation of a permeable zone from other permeable zones in a subterranean formation by a process comprising: packing off of the open hole interval including the permeable zone to be isolated; emplacing a particulate material in the packed off interval and the broken down zones; adhering the particulates of the particulate material together with an adhesive to consolidate the particulates and form a permeable synthetic rock-like material; drilling and reaming out the open hole interval to a greater diameter than the original completion to leave the permeable synthetic rock-like material in the broken down zone but not horizontally adjacent to isolation zones near the permeable zone to be isolated; setting a smaller diameter casing over the open hole interval; cementing between the smaller diameter casing and the reamed out hole; and perforating to the permeable zone to be isolated to effect fluid communication between the well and the permeable zone to be isolated.

In one aspect, a production well having open hole completion and having been blasted by detonation of high explosives in the well bore is recompleted as an injection well for injection of $CO_2$ into the isolated permeable zone of the formation in a $CO_2$ drive process.

In another aspect, particulate material that is coated with a thermosetting resin such as an epoxy resin or a phenolic resin that is partially cured is slurried into place and allowed to set up such as to form the permeable synthetic rock-like material in situ by stimulation from the heat from the formation.

BRIEF DESCRIPTION OF THE DRAWINGS

FIG. 1 shows a production well that has been completed open hole into a subterranean formation and shot with high explosives at a multiplicity of points to enhance production from permeable subterranean zones.

FIG. 2 shows the embodiment of the process wherein the open hole interval has been packed off and a particulate material coated with a partially cured adherence has been placed in the packed off interval and broken down zones.

FIG. 3 illustrates the process later, wherein the particulates are adhered together to form a permeable synthetic rock-like mass in the packed off interval, with a bit in place ready to drill out the interval to the inside diameter of the cased well bore.

FIG. 4 shows the process still later, wherein drilling out of the synthetic permeable rock-like mass has been completed.

FIG. 5 shows a following later stage of the process wherein a reamer has been expanded in place so as to ream out the open bore interval to a diameter slightly larger than the original well bore.

FIG. 6 illustrates the process after reaming to the bottom of the open hole interval.

FIG. 7 illustrates the process after a smaller diameter casing has been set, at a stage near the end of the cementing procedure to cement the smaller diameter casing in place.

FIG. 8 shows the process after the well has been recompleted for injection of fluid into a selected permeable subterranean zone.

DESCRIPTION OF THE DRAWINGS

The drawings and description thereof, as well as the exemplification and description relating to preferred modes are provided to more fully explain the invention and to provide information to those skilled in the art on how to carry it out. However, it is to be understood that such is not to function as a limitation on the invention as described and claimed in the entirety of this application.

FIGS. 1 through 8 illustrate stages in one presently particularly preferred mode of the invention wherein a shot open hole completion production well is recompleted as a cased hole injection well for injection of fluids into a selected permeable subterranean zone. The same numbers are used in the various figures to refer to the same items.

Figure 1:
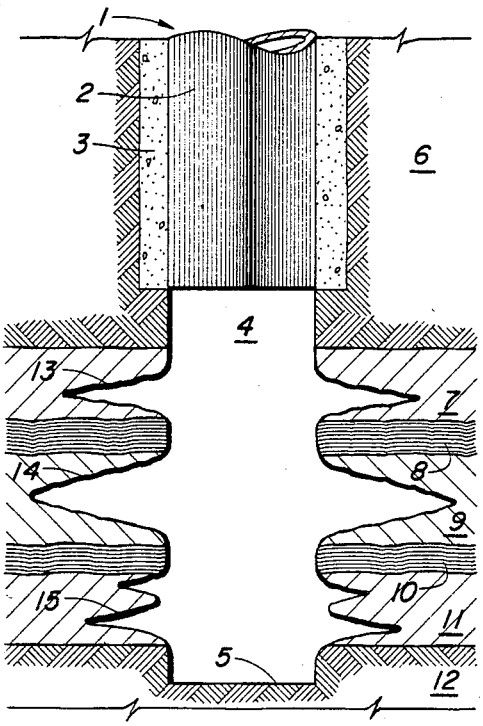
FIGS. 1 through 8 illustrate in semischematic fashion, by means of a cut-away section of a bore hole penetrating a subterranean formation, a presently preferred mode of the invention wherein a shot open hole production well is converted to a cased and cemented well bore for injection into a specific permeable subterranean zone to the exclusion of other permeable subterranean zones.

Thus, referring to FIG. 1, a shot open hole completion production well 1, to be recompleted according to the presently preferred mode of the invention, is illustrated. The well bore has casing 2 cemented in place by cement 3 from the surface to near the production zones. From the bottom of the cased hole completion, the well 4 is completed open hole to depth 5 through overburden 6, first permeable zone 7, first impermeable zone 8, second permeable zone 9, second impermeable zone 10, third permeable zone 11, and underburden 12. Cavities 13, 14, and 15 have been blasted in permeable zones 7, 9, and 11 by means of high explosives to enhance the rate of production from the permeable zones. The material from the cavities has been circulated out of the well.

Figure 2:
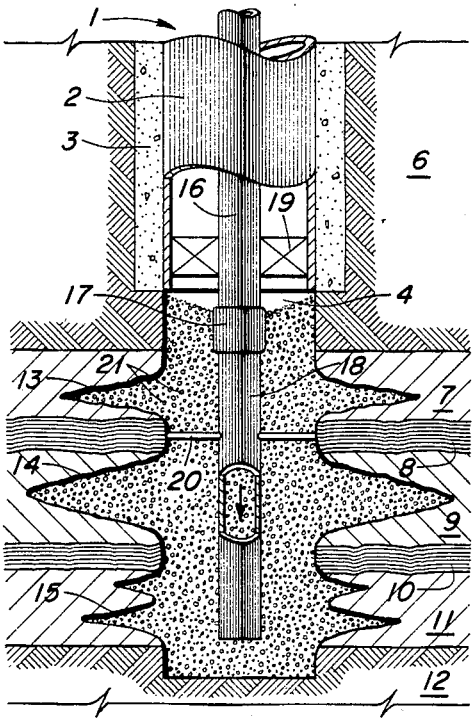

Referring to FIG. 2, a tubing string 16 having break away section 17 and aluminum tail section 18 has been set through packer 19. It is centralized in the uncased portion of the bore hole 4 by means of centralizing spider 20. Coarse sand coated with a partially cured phenolic resin 21 has been injected down tubing string 16 as a slurry such as to fill bore hole 14 and cavities 13, 14, and 15. The fluid from the slurry passes into permeable zones in the formation.

Figure 3:
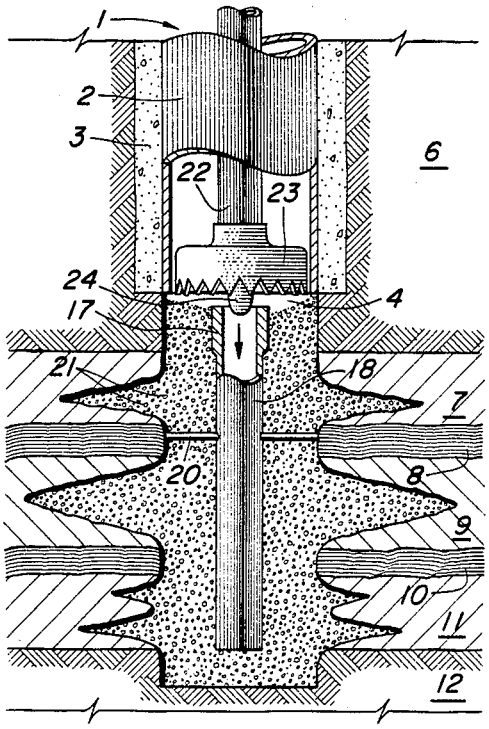

At the stage shown in FIG. 3, the coated coarse sand 21 has set up to a solid permeable synthetic rock-like material under the influence of heat from the subterranean formation. Tubing 16 has been disconnected from break-away section 17 leaving aluminum tail piece 18 and the centralizing spider 20 in the set up solid permeable rock-like material 21. Packer 19 has also been removed, and drill string 22 having cutter head 23 guidable by nose piece 24 (shown in semischematic fashion) has been emplaced.

Figure 4:
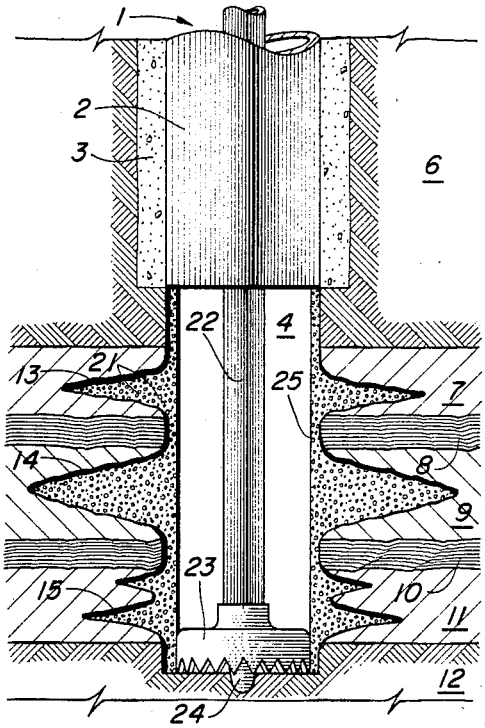

At the stage shown in FIG. 4, drill string 22 has been employed to power cutter head 23 guided by nose piece 24 downward through the consolidated permeable rock-like mass 21 guided and centralized in the bore hole by aluminum tail piece 18 such as to remove consolidated permeable rock-like mass 21, break-away section 17, aluminum tail piece 18, and centralizing spider 20 out of the bore hole by circulation. Consolidated permeable synthetic rock-like material 21 remains in the open hole completion portion of the bore hole only in cavities 13, 14, and 15 and in a thin sheath 25 around the bore hole 4.

Figure 5:
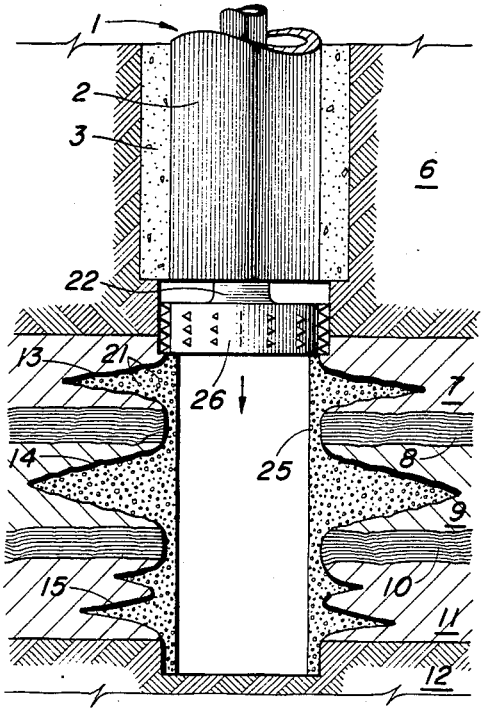

FIG. 5 illustrates a later stage in the process wherein the drill string 22 and cutting head 23 have been removed, and reaming head 26 has been inserted and expanded radially below the cased portion of the well, ready to cut downward so as to remove the sheath 25 of the consolidated permeable rock-like material 21 and to cut a fresh face on the bore hole as it is powered in rotation downward.

Figure 6:
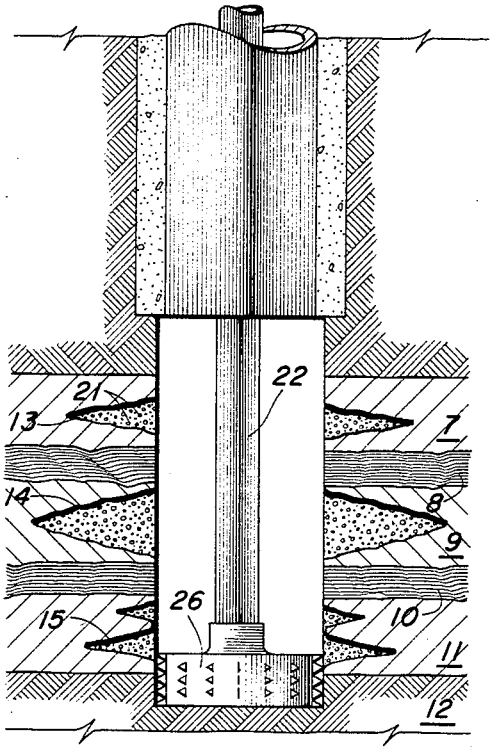

FIG. 6 shows the stage in the process wherein the reaming head 26 has been powered and rotated downward by means of drill string 22 such as to cut the sheath 25 of consolidated permeable rock-like material from around the well bore, and to cut a fresh face on the bore hole particularly in non-permeable zones 8 and 10, while leaving consolidated rock-like permeable material 21 in cavities 13, 14, and 15. Cuttings are circulated out of the well bore.

Figure 7:
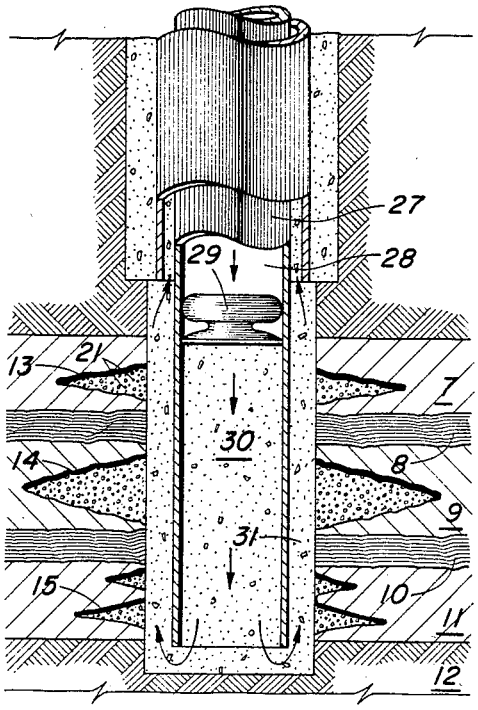

As illustrated in FIG. 7, reaming head 26 has been contracted and removed from the well bore by means of drill string 22. Smaller diameter casing 27 has been lowered into the well bore and is being cemented in place by means of cement 30 being forced down the interior of the smaller diameter casing 27 by means of mud column 28 and wiper plug 29 such as to fill annulus 31. The cement 30 is then forced completely to the bottom of the casing 27 and is allowed to set up. Mud 28 is circulated from the interior of the casing, and the wiper plug 29 can be removed if desired. It should be noted that the cement, upon setting, forms a fluid tight seal between the smaller diameter casing 27 and the face of the formations 7, 8, 9, 10, 11, and 12. The cement abuts consolidated permeable rock-like material in cavities 13, 14, and 15.

Figure 8:
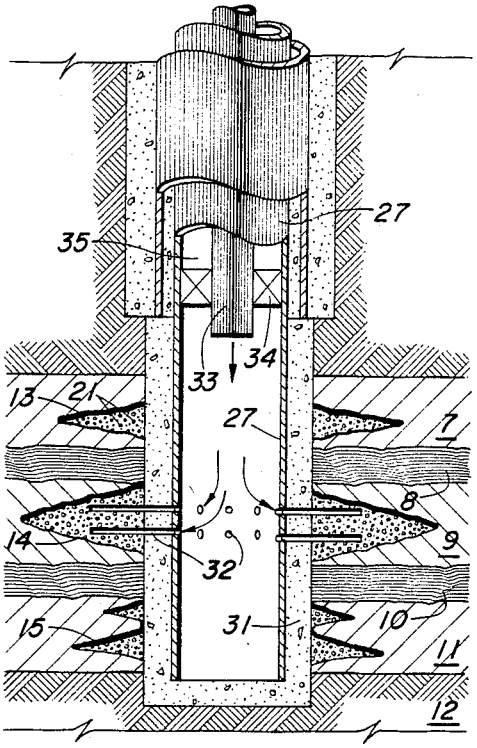

Prior to the stage illustrated in FIG. 8, perforations 32 are made from the interior of casing 27 through casing 27 and cement sheath 31 into the consolidated permeable rock-like material filling cavity 14, so as to establish fluid communication between the interior of casing 27 and permeable rock-like material 21 in cavity 14 within permeable subterranean formation 9, the fluid being isolated from permeable formations 7 and 11 by means of impermeable formations 8 and 10 and impermeable sheath 31.

As shown in FIG. 8, tubing string 33 is set within casing 27, including packer 34 forming annulus 35. Fluid communication is thus effected selectively with permeable subterranean zone 9; from the surface down tubing string 33 and through perforations 32 and permeable rock-like material in cavity 14. Fluid communication with permeable zones 7 and 11 is excluded by impermeable zones 8 and 10 and impermeable cement sheath 31.

The blasted former open hole completion production well is thus converted to a cased injection well having fluid communication only with the desired permeable subterranean zone.

PREFERRED EMBODIMENTS OF THE INVENTION

A presently preferred embodiment of the invention has been particularly described in the preceding section in connection with the detailed description of the drawings. Other presently preferred modes are hereinafter described and further elaboration is provided.

In a basic embodiment, the invention relates to establishment of fluid communication between a cased and cemented well bore and a permeable zone. The communication is isolated from other subterranean permeable zones by reconstituting isolation of the permeable zone of interest from other permeable zones by restoring the impermeability of zones therebetween near a well bore.

The foregoing is effected by packing off the open hole interval including the permeable zone to be isolated and including an impermeable subterranean zone separating the permeable zone to be isolated from other permeable subterranean zones. Conventional oil field packers of various types can be employed. Packing procedures and equipment are well known in the oil industry and in the oil field service industry.

Thereupon, a particulate material is placed in the packed off interval and broken down zone; and the particulates of the particulate material are adhered together with an adhesive to consolidate the particulates and to form a permeable synthetic rock like material. In accordance with one presently preferred mode, the particulates are coated with a solid, fusible resin which is partially cured. The resin can be a phenolic resin or a partially cured epoxy resin. U.S. Pat. No. 3,929,191 discloses one suitable method. In accordance with another mode, the particulates are placed at the desired site, and the adhesive, such as a phenolic resin or an epoxy resin (or precursors thereof) is emplaced within the particulate material mass by injecting a slug of the adhesive or precursors followed by a pusher slug. Such methods are also well known to the industry, and are commerically available. By whichever mode that is used, the particles are adhered together to form a permeable synthetic rock-like mass in the packed off interval and extending into broken down zones to reconstitute permeable subterranean zones.

Thereupon, the synthetic permeable rock-like mass is drilled and/or reamed out to a greater diameter than the original completion so as to leave the permeable synthetic rock-like material in the broken down permeable zone, thus reconstituting the permeable zone, but not adjacent to a nonpermeable isolation zone adjacent to the permeable zone to be isolated. Usually, a number of permeable zones will exist in subterranean formations which are separated by nonpermeable zones in the formations. This is often true for production wells after primary production from formations having relatively thin production zones wherein open hole completion and blasting with high explosives has been employed to maximize recovery rates. Of course, a plurality or multiplicity of permeable and nonpermeable zones separated by a plurality or multiplicity of nonpermeable zones may be present, and often is, depending upon the particular reservoir to be operated upon.

One preferred method of drilling and reaming out the open hole interval involves using an aluminum tail pipe to emplace the particulates prior to setting up to form the permeable synthetic rock-like material, shearing the tubing string so as to leave the aluminum tail pipe in place in the set permeable material, and then employing a drill with a guiding nose piece so as to center the drill and reaming operation so as to more precisely remove the set permeable material, with centering on the original bore hole. Such drilling and/or reaming techniques are well known to those skilled in the art, and are well known in the petroleum and oil service industries.

The tail pipe, spider, and other elements can be fabricated of aluminum or other metal that is readily attacked by acid or the like so that they can be removed by an acid treatment or the like.

After the drilling and/or reaming operation described hereinabove is completed, a casing is set over the open hole interval. The casing is then cemented in place. Ordinary casing setting and cementing procedures, which are well known and practiced in the oil and oil service industries, are employed. Often, the casing is set in place, and cement is forced down the casing and up the annulus by means of a wiper plug and mud. The mud is then circulated out of the well bore within the casing after setting of the cement by means of a tubing string or the like. Such techniques are also ordinary oil field operating procedure well known in the petroleum and well service industries.

Thereupon, perforations are formed in the casing and setup cement sheath by means of a conventional perforating technique, for example, with a conventional perforating gun, by means of a high temperature jet, or by means of a high pressure jet of abrasive. Such techniques are also widely practiced and are well known.

Of course, a plurality or multiplicity of such perforating can be effected to open a plurality or multiplicity of zones if desired.

Upon perforation to establish fluid communication between the target permeable zone or zones and the well bore, the open well bore has been recompleted to a closed well bore, and is suitable for precise injection of a fluid into the desired subterranean horizon. A presently preferred application of the process is for recompletion of production wells to injection wells in a $CO_2$ injection enhanced oil recovery project. The $CO_2$ is injected into primarily depleted, but substantial hydrocarbon or oil-containing formations to mobilize the oil and move the oil to production wells for production to the surface and utilization.

The term particulates is used herein. This can include any solid material having sufficient structural and chemical integrity to form the permeable consolidated synthetic rock-like material that is not deteriorated by the reservoir environment. Ordinarily, materials such as course sand, pea gravel, and other graded small gravel of quartz or other rock derived materials are employed because of abundance and low cost. It is also within the scope of the invention to employ other particulates that have resistance to adverse conditions, such as carbon particles, alumina particles, glass beads, ceramic particles, and the like. Other thermosetting resins besides epoxy resins and phenolic resins can also be employed, and inorganic adhesives or cements can also be employed so long as sufficient consolidation of the particulates is effected in the broken down zone in the reservoir to prevent production back into the well bore during operations and so long as the adhesives have resistance to deterioration in the reservoir.

I claim:

1. A process for recompleting a well bore having an open hole interval and having zonal breakdown in the locus of the well bore and the open hole interval to reconstitute isolation of a permeable zone from other permeable zones in a subterranean formation comprising:

(a) packing off the open hole interval including the permeable zone to be isolated, (b) emplacing a particulate material in the packed off interval and the broken down zone, (c) adhering the particulates of the particulate material together with an adhesive to consolidate the particulates and to form a permable synthetic rock-like solid material, (d) removing material from along the open hole interval by reaming out to a greater diameter than the original completion so as to leave permeable synthetic rock-like solid material in the broken down zone but not horizontally adjacent to a non-permeable isolation zone which is situated vertically adjacent to the permeable zone to be isolated and which hroizontally abuts the reamed out hole, (e) setting a smaller diameter casing over the open hole interval, (f) cementing between the smaller diameter casing and the reamed out hole of (d), and (g) perforating to the permeable zone to be isolated to effect fluid communication between the well and the permeable zone to be isolated.

2. The process of claim 1 wherein a production well (having open hole completion and having zonal breakdown in the open hole completion formed by detonation of high explosives in the well bore) is recompleted as an injection well for injection of $CO_2$ into the isolated permeable zone of the formation in an enhanced oil recovery process.

3. The process of claim 2 wherein the particulate material is sand and/or gravel and wherein the adhesive is comprised of a high strength thermosetting resin.

4. The process of claim 3 wherein sand or gravel particles coated with a partially cured thermosetting resin are slurried into the packed off interval and the broken down zone and allowed to cure by means of heat from the formation in the packed off interval and broken down zone to form the permeable synthetic rock-like solid material therein.

5. The process of claim 4 wherein the synthetic rock-like solid material is formed from sand and/or gravel coated with a partially cured epoxy resin or a partially cured phenolic resin.

* * * * *